US007457554B2

(12) United States Patent
Matsuda et al.

(10) Patent No.: US 7,457,554 B2
(45) Date of Patent: Nov. 25, 2008

(54) IMAGE FORMING APPARATUS WHEREIN AN IMAGE FORMING REGION AND A NON-IMAGE FORMING REGION ARE CHARGED WITH DIFFERENT POTENTIALS

(75) Inventors: Kohei Matsuda, Shizuoka-ken (JP); Tetsuya Kobayashi, Numazu (JP); Shinya Yamamoto, Numazu (JP); Masato Koyanagi, Mishima (JP); Kentaro Kawata, Numazu (JP); Shinichi Agata, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 11/132,343

(22) Filed: May 19, 2005

(65) Prior Publication Data

US 2005/0260006 A1 Nov. 24, 2005

(30) Foreign Application Priority Data

May 20, 2004 (JP) ..... 2004-150565
May 18, 2005 (JP) ..... 2005-145531

(51) Int. Cl.
*G03G 15/02* (2006.01)

(52) U.S. Cl. ..... 399/50

(58) Field of Classification Search ..... 399/50, 399/168

See application file for complete search history.

(56) References Cited

U.S. PATENT DOCUMENTS 5,701,551 A * 12/1997 Honda et al. ..... 399/50

FOREIGN PATENT DOCUMENTS

| | | |
|---|---|---|
| JP | 2-212876 A | 8/1990 |
| JP | 4-29169 A | 1/1992 |
| JP | 7-248665 | 9/1995 |
| JP | 8-137361 | 5/1996 |
| JP | 9-80871 A | 3/1997 |
| JP | 10-207262 | 8/1998 |
| JP | 2001-13745 A | 1/2001 |

* cited by examiner

*Primary Examiner*—Quana M Grainger
(74) *Attorney, Agent, or Firm*—Fitzpatrick, Cella, Harper & Scinto

(57) ABSTRACT

An image forming apparatus includes a rotatable image bearing member on which an electrostatic latent image is formed, a charging member, and a transfer member. A charging potential of the charging member is different between when the charging member provides a first region on the image bearing member with a potential and when the charging member provides a second region on the image bearing member with a potential, thus providing a predetermined potential difference between the first region and the second region. A third region on the image bearing member, with the transfer member being supplied with a voltage to provide a predetermined potential difference between a potential of the third region before being charged by the charging member and a potential of the third region after being charged by the charging member.

12 Claims, 7 Drawing Sheets

IMAGE FORMING APPARATUS WHEREIN AN IMAGE FORMING REGION AND A NON-IMAGE FORMING REGION ARE CHARGED WITH DIFFERENT POTENTIALS

FIELD OF THE INVENTION AND RELATED ART

The present invention relates to an electrophotographic image forming apparatus.

As for examples of an electrophotographic image forming apparatus, they include a copying machine, a laser beam printer, an LED printer, a facsimile machine, etc.

FIG. 6 is a schematic drawing of a typical image forming apparatus in accordance with the prior art, which employs one of the electrophotographic image forming methods.

The image forming apparatus in accordance with the prior art comprises: a photosensitive drum 100 which is an electrostatic image bearing member; a charge roller 201 for uniformly charging the photosensitive drum 100; an exposing apparatus 300 for forming an electrostatic latent image which is in accordance with printing data and image data, on the charged photosensitive drum 100, by projecting a beam of laser light onto the peripheral surface of the photosensitive drum 100; a development roller 401 for developing an electrostatic latent image formed on the peripheral surface of the photosensitive drum 100, into a visible image, with the use of developer (toner); a transfer roller 501 for transferring the visible image (image formed of toner) onto a recording medium 900; a cleaning apparatus 600 for removing the toner remaining on the peripheral surface of the photosensitive drum 100 after the transfer, or the like residues; a fixing apparatus 800 for permanently fixing the visible image (image formed of toner) on the recording medium 900; and a cassette 700 as a paper feeding apparatus for feeding the recording media 900 into the main assembly of the image forming apparatus.

The image forming process carried out by the above described image forming apparatus in accordance with the prior art is as follows: It is carried out with the timing shown in FIG. 7, which shows the relationships among a given point (line) on the peripheral surface of the photosensitive drum 100, changes in the charge bias, surface potential level of the photosensitive drum 100, and transfer bias. The horizontal axis represents the length of time a given point (line) of the peripheral surface of the photosensitive drum 100 is moved in the circumferential direction of the photosensitive drum 100 by the rotation of the photosensitive drum 100. In FIG. 7, each of the intervals of the plurality of vertical broken lines parallel to the vertical axis represents the circumference of the photosensitive drum 100. The horizontal axis represents the length of elapsed time.

First, the main assembly of the image forming apparatus receives a print command from an external computer or the like. As the print command is received (Step 1), the rotation of the photosensitive drum 100 is started (Step 2). Then, −1000 V of charge bias is applied to the charging apparatus 200 (Step 3), uniformly charging the peripheral surface of the photosensitive drum 100 to the dark point potential level (VD), which is −500 V (Step 4). Meanwhile, to the charge roller 201, a predetermined bias is continuously applied regardless of whether it is prior to or during an image forming operation, or it is during the intervals of a plurality of image forming operations.

Thereafter, an electrostatic latent image is formed by the exposing apparatus, on the peripheral surface of the photosensitive drum 100 having just been charged to the potential level of VD. As a result, the potential level of the numerous exposed points of the peripheral surface of the photosensitive drum 100 changes to the light potential level (VL) (for convenience, FIG. 7 shows potential level of peripheral surface of photosensitive drum 100 prior to exposure).

As the electrostatic latent image on the photosensitive drum 100 reaches the development roller 401, it is developed into a visible image; a visible image is formed of toner, on the peripheral surface of the photosensitive drum 100 (hereinafter, visible image formed of toner will be referred to simply as toner image).

As the toner image on the photosensitive drum 100 reaches the transfer roller 501, a predetermined transfer bias is applied to the transfer roller 501 (Step 5), causing thereby the toner image to be electrostatically transferred onto the recording medium 900 delivered from the cassette 700 as a sheet feeding apparatus, in synchronism with the print command. Thereafter, the recording medium 900, onto which the toner image has just been transferred, is conveyed to the fixing apparatus 800, in which the toner image is permanently fixed to the recording medium 900 by the application of heat and pressure.

As the transfer residual toner, that is, the toner remaining on the photosensitive drum 100 after being moved past the transfer roller 501, reaches the cleaning apparatus 600, it is removed from the photosensitive drum 100 by the cleaning apparatus 600, and the area of the photosensitive drum 100 cleared of the transfer residual toner is charged again by the charge roller 201 to be readied for the following image formation.

Some of the image forming apparatuses similar in structure and operation to the above described image forming apparatus are provided with a function of adjusting the print bias (Japanese Laid-open Patent Application 10-207262), with the use of the transferring apparatus. More specifically, transfer bias is applied during paper intervals (image formation intervals), and the current which flows during the application of the transfer bias is monitored. Then, the changes in the electrical resistance of the transferring member are detected based on the value of the transfer current. Then, the print bias is adjusted according to the detected changes in the resistance value of the transferring member.

However, if the transferring apparatus is activated during the paper intervals, that is, the periods in which no image is formed, in addition to the periods in which images are formed, as it is by the prior art disclosed in Japanese Laid-open Patent Application 10-207262, the transfer current continuously flows from the transferring apparatus to the photosensitive drum regardless of whether the transfer roller is in contact with the area of the photosensitive drum, across which no image has been form, or the area of the photosensitive drum across which an image has just been formed. If the leading edge of a recording medium enters the transfer nip while the transferring apparatus is in the above described state, the transfer current suddenly drops due to the sudden change in the electrostatic capacity of the transfer nip portion. This sudden drop in the transfer current causes the point (line) of the peripheral surface of the photosensitive drum, which corresponds to the sudden drop in transfer current, to suffer from a hysteresis in potential level, resulting sometimes in the formation of defective images. In the case of image forming apparatuses in accordance with the prior art, this kind of phenomenon has not resulted in conspicuous problems. However, with the increase in the printing speed of an image forming apparatus in recent years, it has come to result in conspicuous image defects. Thus, in recent years, it has become a common practice not to activate a transferring apparatus (keeping transfer bias turned off during paper intervals) while the transferring apparatus is opposing the area of the photosensitive drum, which immediately precedes the area of the photosensitive drum on which an image is going to be formed, in order to prevent this problem. This method has been effective to reduce the problem to a virtually insignificant level.

Further, in the case of image forming apparatuses in accordance with the prior art, such as the one described in the background technology section, the peripheral surface of the photosensitive drum must be continuously charged to keep its potential level at a predetermined level, that is, VD, in order to prevent toner from transferring from a developing apparatus onto the wrong points of the peripheral surface of the photosensitive drum. Thus, to the charging apparatus, a predetermined charge bias is continuously applied regardless of whether it is prior to an actual image forming operation, during an actual image forming operation, or during the image formation intervals.

Thus, image forming apparatuses which satisfy the above described conditions suffer from the following problems, for which various countermeasures are necessary.

Normally, to the area of the photosensitive drum, across which an image has just been formed, positive transfer bias is applied by a transferring member in order to transfer the image (toner image) onto a recording medium. As a result, the potential level of this area of the photosensitive drum reduces to a potential level lower than VD, in terms of absolute value.

However, when transfer bias is not applied to the area of the photosensitive drum, which immediately precedes the area of the photosensitive drum across which an image is to be formed, and the area of the photosensitive drum which corresponds to the image formation interval, the electrical charge is scarcely removed from these areas, leaving therefore the potential levels of these areas after the completion of the transferring process virtually the same as those prior to the transferring process. In other words, the amount by which the potential levels of these areas become equal the very minute amount by which they naturally attenuate. This amount by which these areas attenuate in potential level is extremely small compared to the amount by which the area, to which transfer bias is applied, reduces in potential level. As a result, the peripheral surface of the photosensitive drum becomes nonuniform in potential level in term of the lengthwise direction and circumferential direction of the photosensitive drum.

If the area of the peripheral surface of the photosensitive drum, which has become nonuniform in potential level because the amount by which the abovementioned areas of the peripheral surface of the photosensitive drum attenuate in potential level from the VD is extremely small, is charged again to raise its potential level to its original level, that is, VD, it is extremely nonuniformly charged, because the amount of contrast in potential level between its potential level, and the potential level to which it is to be charged, is insufficient. As a result, images suffering from image defects, more specifically, horizontal stripes, are formed.

SUMMARY OF THE INVENTION

The primary object of the present invention is to realize a sufficient amount of contrast in potential level between the potential level of a given point (line) of the peripheral surface of a photosensitive drum, and the potential level to which the given point is to be charged, in order to prevent the photosensitive drum from being nonuniformly charged.

Another object of the present invention is to prevent the formation of images suffering from the image defects in the form of a horizontal stripe.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, a few of the preferred embodiments of the present invention will be described in detail with reference to the appended drawings.

However, the measurements, materials, and shape of the structural components of the image forming apparatuses in the following embodiments of the present invention, and the positional relationship among them, should be altered, as necessary, according to the structure of an image forming apparatus to which the present invention is applied, and various conditions in which the apparatus is operated. In other words, the following embodiments of the present invention are not intended to limit the scope of the present invention.

Embodiment 1

Next, the first embodiment of the present invention will be described with reference to the appended drawings.

Figure 1:
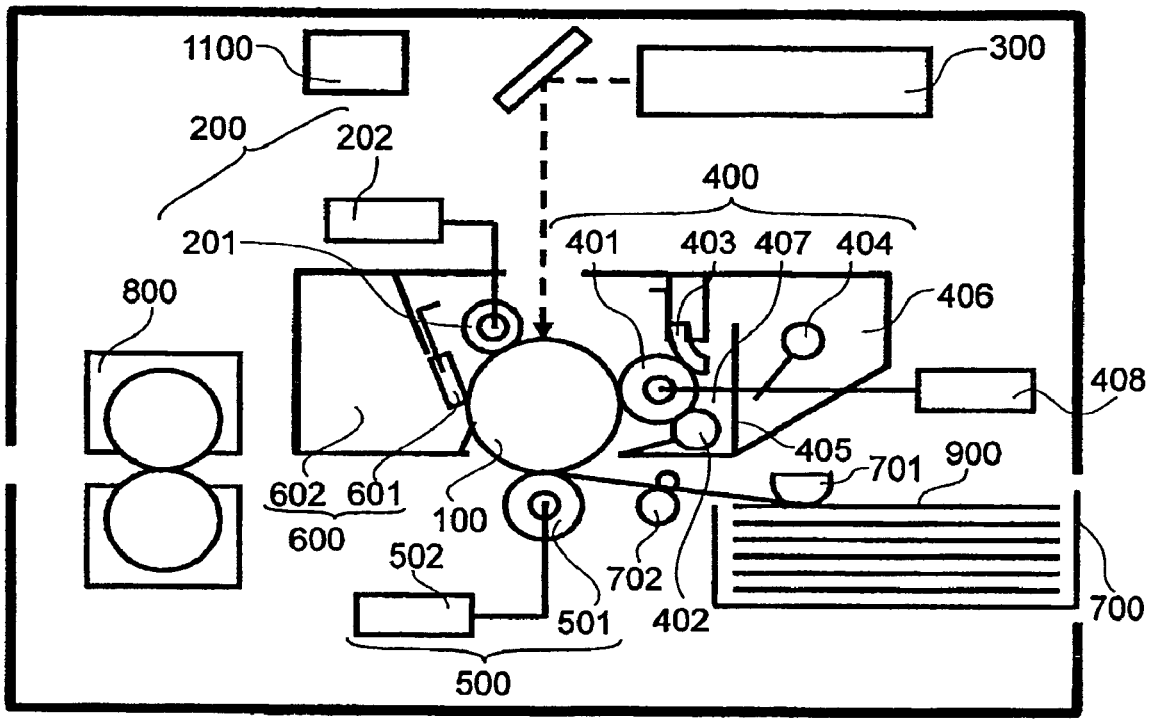
FIG. 1 is a schematic drawing of the image forming apparatus in the first embodiment of the present invention.

FIG. 1 is a schematic drawing of the image forming apparatus in the first embodiment of the present invention.

This image forming apparatus is provided with a photosensitive drum 100 as an image bearing member, on which an electrostatic latent image is formed, and which is disposed in the center portion of the main assembly of the image forming apparatus. Disposed in the adjacencies of the peripheral surface of the photosensitive drum 100 in a manner of surrounding the photosensitive drum 100 are: a charging apparatus 200 for uniformly charging the photosensitive drum 100 with the utilization of electrical discharge; an exposing apparatus 300 for forming on the charged peripheral surface of the photosensitive drum 100, an electrostatic latent image in accordance with the printing data and image data, by projecting a beam of laser light upon the peripheral surface of the photosensitive drum 100; a developing apparatus 400 for developing an electrostatic latent image formed on the peripheral surface of the photosensitive drum 100, into a visible image (image formed of toner) with the use of developer (toner); a transferring apparatus 500 for transferring the visible image (image formed of toner) onto a recording medium 900 as an object onto which the image is to be transferred; a cleaning apparatus 600 for removing the toner remaining on the peripheral surface of the photosensitive drum 100 after the transfer, or the like residues; a fixing apparatus 600 for permanently fixing the visible image (image formed of toner) on the recording medium 900; and a cassette 700 for feeding the recording media 900 into the main assembly of the image forming apparatus.

To describe each of the above mentioned components in more detail, the photosensitive drum 100 is made up of an aluminum cylinder with a diameter of 30 mm, and three functional layers, which are a 1 μm thick layer of undercoat, a several micrometers thick charge generation layer (CGL), and an 18 μm thick charge transfer layer (CTL), which are coated in layers in the listed order, on the peripheral surface of the aluminum cylinder. The photosensitive drum 100 is rotated about its axial line in a predetermined direction. The peripheral velocity at which the photosensitive drum 100 is rotated is roughly 94 mm/sec. Thus, it takes roughly one second for the photosensitive drum 100 to rotate one full turn.

The charging apparatus 2 is essentially made up of a charge roller 201, an electrically conductive supporting member (unshown), springy members (unshown), and a charge bias power source 202. The charge roller 201 is made up of a metallic core with a diameter of 6 mm, a roughly three millimeters thick electrically conductive elastic layer (intermediate layer) coated on the peripheral surface of the metallic core, and a several micrometers thick urethane layer (film) (surface layer) which covers the electrically conductive elastic layer. The surface layer is formed of urethane rubber, and carbon black dispersed in the urethane rubber. It is highly electrically resistant. The supporting member is rotatably supported by its lengthwise ends, rotatably supporting thereby the charge roller 201. The springy members keep the supporting member pressed toward the photosensitive drum 100, keeping thereby the charge roller 201 pressed on the peripheral surface of the photosensitive drum 100. The charge bias power source 202 applies voltage to the charge roller 201 through the springy members and supporting member.

The charge roller 201 is disposed so that it remains in contact with the peripheral surface of the photosensitive drum 100 and is rotated by the rotation of the photosensitive drum 100. To the charge roller 201, a charge bias, the potential level of which exceeds the potential level of the charge starting voltage, is applied from the charge bias power source 202, causing thereby electrical discharge between the photosensitive drum 100 and charge roller 201 to charge the photosensitive drum 100. Here, the charge start voltage means the amount of the difference in potential level between the charge roller 201 and photosensitive drum 100, above which electrical discharge occurs between the charge roller 201 and photosensitive drum 100. As voltage is applied to the charge roller 201, the surface potential level of the photosensitive drum 100 changes to a value equal to the difference between the potential level of the voltage applied to the charge roller 201 and the discharge starting voltage. In this embodiment, the discharge starting voltage is 500 V, and roughly −1,000 V of DC voltage is applied to the charge roller 201. Thus, the peripheral surface of the photosensitive drum 100 is charged to −500 V, that is, dark point potential level (VD).

The above described method of charging the photosensitive drum 100 by applying only DC voltage (without applying AC voltage at all), that is, the so-called DC charging method of the contact type, is advantageous over the so-called AC charging method, that is, the method for charging a photosensitive drum by applying to a charge roller the combination of DC voltage and AC voltage, in that the former is lower in the amount of ozone production, lower in apparatus cost, etc. The former has another advantage over the latter in that it is smaller in the amount of the electrical current involved with the electrical discharge necessary for charging the peripheral surface of the photosensitive drum to a predetermined potential level, and therefore, is smaller in the amount by which the peripheral surface of the photosensitive drum is shaved.

After the peripheral surface of the photosensitive drum 100 is charged by the charging apparatus 200 to the predetermined potential level, or VD, it is exposed by the exposing apparatus 300 according to the printing data and image data. As a result, the potential level of each of the numerous exposed points of the peripheral surface of the photosensitive drum 100 changes to −100 V, or the light point voltage level (VL).

The developing apparatus 400 has a hopper portion 406 and a development chamber 407, which are separated by a partition wall 405. The hopper portion 406 is for storing toner. In the hopper portion 406, a stirring apparatus 404 is disposed to send toner into the development chamber 407. In the development chamber 407, a development roller 401 as a developing member for developing an electrostatic latent image on the photosensitive drum 100, a supply roller 402 for supplying the development roller 401 with toner, and a metallic development blade for regulating in thickness the toner layer on the peripheral surface of the development roller 401, are disposed. The development roller 401, which is 16 mm in diameter, comprises two layers: the base layer, which is formed of silicon rubber, and a surface layer, which is formed of acrylic urethane rubber, and is coated on the peripheral surface of the base layer. The supply roller 402 is formed of urethane sponge, and is 16 mm in diameter. The development apparatus is structured so that the stirring apparatus 404, development roller 401, and supply roller 402 are externally driven, and also, so that they are continuously rotated to supply the photosensitive drum 100 with toner during the development process.

The development roller 401 is disposed in contact with the peripheral surface of the photosensitive drum 100 in order to develop an electrostatic latent image on the peripheral surface of the photosensitive drum 100. More specifically, as roughly −300 V of DC voltage is applied between the photosensitive drum 100 and development roller 401 from the development bias power source 408, the electrostatic latent image formed on the peripheral surface of the photosensitive drum 100 is developed into a visible image.

The transferring apparatus 500 is made up of a transfer roller 501, and a transfer bias power source 502 for applying voltage to the transfer roller 501. The transfer roller 501 is formed of EPDM sponge, and is 12 mm in diameter. During an image forming operation, the transferring apparatus 501 is controlled so that the potential level of the voltage applied to the transfer roller 501 remains stable.

The recording media 900 stored in the cassette 700 as a sheet feeding apparatus are conveyed one by one by a feed roller 701 to a pair of registration rollers 702 in synchronism with the progression of the formation of the visible image on the photosensitive drum 100. Then, each recording medium 900 is conveyed by the pair of registration rollers 702 to the area between the transfer roller 501 and photosensitive drum 100, in synchronism with the arrival of the leading edge of the visible image on the photosensitive drum 100 at the area between the transfer roller 501 and photosensitive drum 100.

Then, roughly +2,000 V of DC voltage is applied to the transfer roller 501. As a result, the toner on the photosensitive drum 100 is transferred onto the recording medium 900.

After being transferred onto the recording medium 900, the toner, or the visible image, on the recording medium 900, is conveyed, along with the recording medium 900, to the fixing apparatus 800, in which it is fixed by the application of heat and pressure, yielding thereby a permanent copy.

Meanwhile, the transfer residual toner, that is, the toner remaining on the area of the peripheral surface of the photosensitive drum 100, which has moved past the transferring apparatus, is removed from the photosensitive drum 100 by the cleaning apparatus 600 having a cleaning blade 601 formed of polyurethane rubber, and then, is stored in a waste toner container 602. Thereafter, the area of the peripheral surface of the photosensitive drum 100, which has just been cleared of the transfer residual toner, is charged again for the following image forming process, by the charging apparatus 200.

A CPU 1100, which is a controlling apparatus, controls the voltages applied to the charge roller 201, development roller 401, and transfer roller 501 by controlling the charge bias power source 202, development bias power source 408, and transfer bias power source 502, respectively.

Next, the formation of a defective image by an image forming apparatus in accordance with the prior art, which is attributable to the nonuniform charging of the photosensitive drum in the image forming apparatus, will be described.

In the case of an image forming apparatus in accordance with the prior art, in order to prevent the problem that toner is adhered to the peripheral surface of the photosensitive drum by the developing apparatus, the peripheral surface of the photosensitive drum needs to be continuously charged so that its surface potential level remains at VD. Thus, to the charging apparatus, a predetermined charge bias is continuously charged whether it is prior to the actual image forming operation, during the actual image forming operation, or during the image formation intervals. Therefore, if transfer bias is not applied to the transfer roller 501 while the transfer roller 501 is in contact with the area of the peripheral surface of the photosensitive drum 100, which immediately precedes the area of the peripheral surface of the photosensitive drum 100, and on which an image is not formed, in order to prevent the peripheral surface of the photosensitive drum suffering from the hysteresis in potential level, the occurrence of which coincides in time with the entry of the leading edge of the recording medium into the transfer nip, this area of the peripheral surface of the photosensitive drum 100 is not reduced in potential level, and therefore, the potential level of this area remains virtually the same level as VD. Then, it is placed in contact with the charge roller 201 to be charged to VD. In other words, it is subjected to the charging process when the amount of the contrast in potential level between the area to be charged, and the potential level to which the area is to be charged, is insufficient. In such a case, the peripheral surface of the photosensitive drum 100 is drastically nonuniformly charged, which results in the formation of a defective image. The contrast in potential level means the difference between the potential level of a given point of the peripheral surface of the photosensitive drum 100 prior to the charging of this point of the photosensitive drum 100, and the potential level to which this point of the peripheral surface of the photosensitive drum 100 is to be charged.

Figure 2:
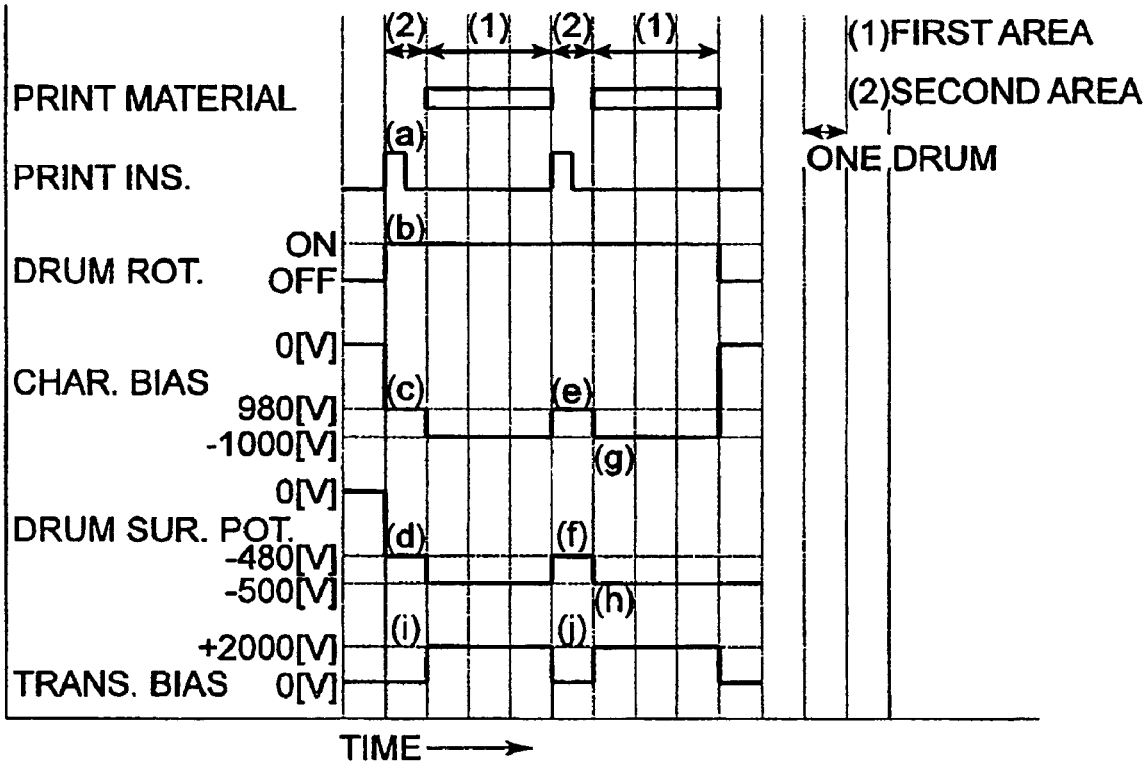
FIG. 2 is a timing chart of the image forming operation carried out by the image forming apparatus in the first embodiment.

In this embodiment, therefore, in order to prevent the peripheral surface of the photosensitive drum 100 from being nonuniformly charged, by realizing a sufficient amount of potential level contrast prior to the charging of the photosensitive drum 100, the transferring apparatus 501 is controlled with the timing shown in FIG. 2, which shows the relationships among the charge bias, surface potential level (after being moved past charging apparatus), and transfer bias. FIG. 2 is drawn so that the same points of the peripheral surface of the photosensitive drum vertically align. Further, the length of the interval between adjacent two broken lines parallel to the vertical axis of the diagram is equivalent to the circumference of the photosensitive drum 100. The horizontal axis represents the length of the elapsed time. Ordinarily, the peripheral surface of the photosensitive drum 100 is exposed according to the printing data and image data, which causes the potential level of each of the numerous exposed points of the peripheral surface of the photosensitive drum 100 to reduce to VL. However, for convenience, FIG. 2 shows only the potential level of the peripheral surface of the photosensitive drum 100 prior to the exposure.

In FIG. 2, the area of the peripheral surface of the photosensitive drum 100, which has just been charged by the charging apparatus, and across which a toner image is going to be formed, is referred to as the first area. Further, the area of the peripheral surface of the photosensitive drum 100, which immediately precedes the first area, in terms of the rotational direction of the photosensitive drum 100, and across which a toner image is not formed, is referred to as the second area.

As the main assembly of the image forming apparatus receives a print command from an external computer or the like (Step a), the rotation of the photosensitive drum 100 is started (Step b). Thereafter, in the case of an image forming apparatus in accordance with the prior art (which hereinafter will be referred to simply as conventional image forming apparatus), −1,000 V, which is the voltage as the charge bias to be applied to the first area, across which a toner image is to be formed, is applied to the charging apparatus 200 to charge the peripheral surface of the photosensitive drum 100 to −500 V, that is, VD (discharge starting voltage is 500 V). In this embodiment, however, −980 V, which is lower in absolute value than the charge bias to be applied to the charge roller when the first area is in contact with the charge roller, is applied to the charge roller when the charge roller is in contact with the second area which immediately precedes the first area, across which the normal image forming operation is carried out (Step c). As a result, the second area is charged to −480 V, which is lower in absolute value than the potential level to which the first area is to be charged (Step d).

Further, in the case of the conventional image forming apparatus, when printing two copies in succession, more specifically, when charging the area of the peripheral surface of the photosensitive drum 100, which corresponds to the image formation interval between the first and second copies, immediately after the completion of the formation of the first copy, the potential level of the charge bias applied to the charge roller 201 is left at −1,000 V, which is the same as that applied to the charge roller 201 to charge the first area. In this embodiment, however, when charging the second area, which corresponds to the interval between the first and second copies, the charge bias is switched to −980 V (Step e), charging thereby the second area to −480 V (Step f).

Thereafter, that is, when charging the area of the peripheral surface of the photosensitive drum 100, across which a toner image is formed for the second copy, −1,000 V, which is the normal voltage to be charged for image formation, is applied to the charge roller (Step g), charging thereby the first area to −500 V for image formation (Step h).

Moreover, while the second area is moved through the transferring portion (Steps i and j), the transfer bias is kept at zero, that is, the transfer bias is not applied. With the employment of the above described sequence, it is possible to eliminate the problem that transfer current causes the peripheral surface of the photosensitive drum 100 to suffer from the hysteresis in potential level, which leads to the formation of a defective image.

When printing three or more copies in succession, the above described sequence is repeated.

The following Table 1 shows the results of the tests carried out to examine the effectiveness of the above described sequence. In the tests, the difference in surface potential level between the first area and second area is varied (widened) by varying the charge bias applied to the charge roller to charge the second area, and the presence (absence) of the image defects attributable to nonuniformity in the charging of the peripheral surface of the photosensitive drum 100 is checked. In Table 1, that the difference in potential level between the first area and second area is 0 V means that the charge bias applied during the period which corresponds to recording medium interval is identical to the charge bias applied during the period in which an image is actually formed.

TABLE 1

| Potential difference between 1st area and 2nd area | Image defect |
|---|---|
| 0 V | Yes |
| 5 V | Almost Non |
| 10 V | Almost Non |
| 15 V | Almost Non |
| 20 V | Non |
| 25 V | Non |
| 30 V | Non |

As will be evident from the results shown in Table 1, when the difference in potential level between the first area and second area was no less than 20 V in absolute value, no image suffering from the defects attributable to the nonuniform charging of the photosensitive drum 100 was yielded; very satisfactory images were yielded. In other words, when there is a sufficient amount of difference in potential level between the first area and second area, electrical discharge occurs by a satisfactory amount between the charge roller and photosensitive drum no matter which point of the peripheral surface of the photosensitive drum is in contact with the charge roller, and therefore, it does not occur that the peripheral surface of the photosensitive drum is nonuniformly charged.

In summary, in this embodiment, the charge bias applied when charging the area of the peripheral surface of the photosensitive drum, which immediately precedes the area of the peripheral surface of the photosensitive drum, across which an image is going to be formed, and the area of the peripheral surface of the photosensitive drum, which corresponds to the interval between the two recording media, is rendered different in potential level from the charge bias applied during the period in which an image is actually formed; −980 V is applied instead of the normal potential level for image formation. As a result, these two areas of the peripheral surface of the photosensitive drum are charged to −480 V, which is lower in absolute value than −500 V, to which the area of the peripheral surface of the photosensitive drum, across which an image is formed, is charged. In the tests, in which 10,000 copies were continuously made with the image forming apparatus set as described above, excellent images, that is, images which did not suffer from the defects attributable to the nonuniform charging of the photosensitive drum resulting from the insufficient amount of contrast in potential level between the area of the peripheral surface of the photosensitive drum, which immediately preceded the area of the peripheral surface of the photosensitive drum, across which an image was to be formed, were formed. In other words, the charge bias applied to charge the area of the peripheral surface of the photosensitive drum, which immediately preceded the first area, that is, the area of the peripheral surface of the photosensitive drum across which an image was formed, and the charge bias applied to charge the second area of the peripheral surface of the photosensitive drum, which corresponded to the recording medium interval, were rendered lower by 20 V in potential level in terms of absolute value than the charge bias applied to charge the first area As a result, a sufficient amount of contrast in potential level was realized between the charge roller and photosensitive drum, prior to the charging of the photosensitive drum, preventing thereby the photosensitive drum from being nonuniformly charged.

As described above, in order to provide a predetermined amount of difference in potential level between the area (second area) of the peripheral surface of the photosensitive drum, which immediately preceded the image forming area (first area) of the peripheral surface of the photosensitive drum, and on which no image was formed, and the first area, the charge bias applied to the charging apparatus to charge the second area was rendered different from the charge bias applied to the first area. As a result, the peripheral surface of the photosensitive drum was prevented from being nonuniformly charged, preventing thereby the formation of images suffering from the defects attributable to the nonuniform charging of the photosensitive drum. Also, providing no less than 20 V of difference in potential level, in terms of absolute value, between the first and second areas of the peripheral surface of the photosensitive drum further improves the image forming apparatus in image quality.

Additionally, it is desired that the surface potential level of the photosensitive drum, and the development bias, are set to prevent the normally charged toner, in terms of polarity, from adhering to the photosensitive drum from the development roller, in order to minimize toner consumption, and also, to prevent the transfer roller from being contaminated.

Further, as long as the potential level to which the second area is charged is set to a value capable of preventing the problem that the normally charged toner, in terms of polarity, is adhered to the photosensitive drum from the development roller due to the relationship between the potential level of the second area and the potential level of the development roller, the potential level to which the second area is to be charged may be rendered the same as the potential level to which the first area is to be charged. This method makes it possible to keep the development bias constant, being therefore simpler in terms of the structural arrangement for controlling the development bias.

When the area across which an image was to be formed was greater, in terms of the direction in which a recording medium was conveyed, than the circumference of the photosensitive drum, it was possible to prevent the peripheral surface of the photosensitive drum from being nonuniformly charged, by controlling the charge bias, etc., so that immediately prior to the formation of the image, the peripheral surface of the photosensitive drum was charged, for a length of time equivalent to a single rotation of the photosensitive drum, to the aforementioned potential level lower in absolute value than the normal potential level to which the peripheral surface of the photosensitive drum was charged for actual image formation, so that the entirety of the peripheral surface of the photosensitive drum was charged to the potential level lower in absolute value than the normal potential level to which the first area was charged for image formation.

Embodiment 2

Next, referring to FIG. 3, the second embodiment of the present invention will be described.

This embodiment concerns an image forming operation for forming an image on both surfaces of a recording medium (two-sided print mode) The structure of the image forming apparatus in this embodiment is basically the same as that of the image forming apparatus in the first embodiment. Therefore, the components of the image forming apparatus in this embodiment which are basically the same in structure to those in the first embodiment will not be described.

Figure 3:
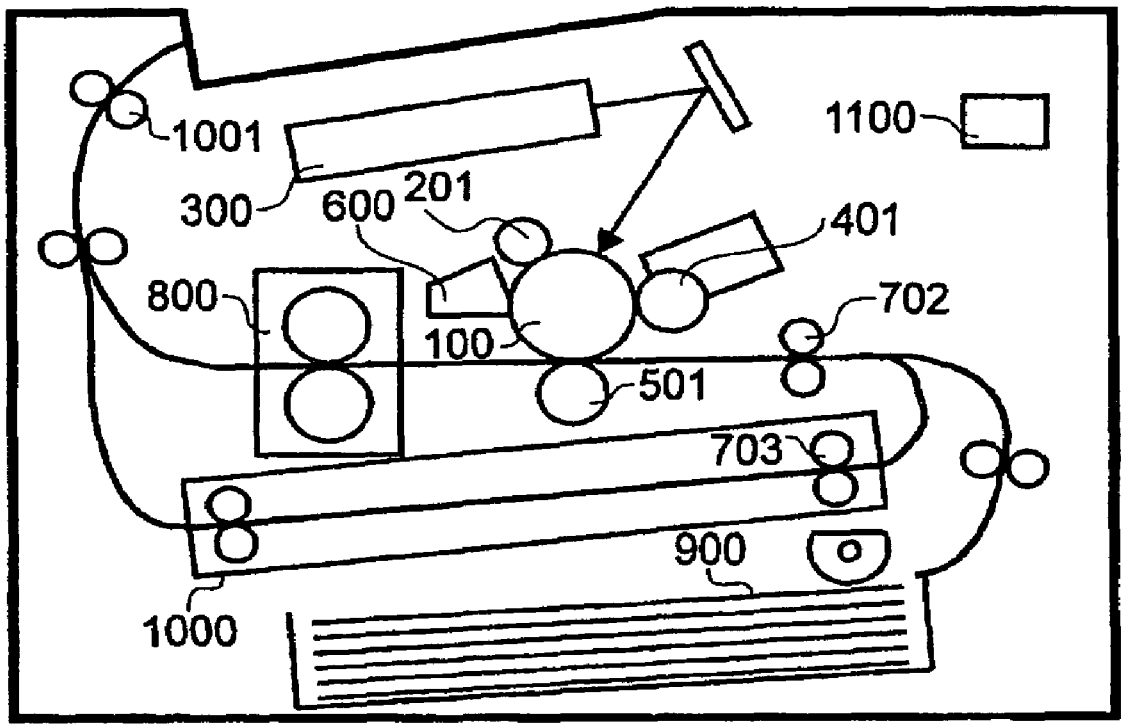
FIG. 3 is a schematic drawing of the image forming apparatus in the second embodiment of the present invention.

FIG. 3 is a schematic drawing of the image forming apparatus in this embodiment.

This image forming apparatus is provided with a photosensitive drum 100 as an image bearing member, on which an electrostatic latent image is formed, and which is disposed in the center portion of the main assembly of the image forming apparatus. Disposed in the adjacencies of the peripheral surface of the photosensitive drum 100 in a manner of surrounding the photosensitive drum 100 are: a charging apparatus 200 for uniformly charging the photosensitive drum 100 with the utilization of electrical discharge; an exposing apparatus 300 for forming on the charged peripheral surface of the photosensitive drum 100, an electrostatic latent image in accordance with the printing data and image data, by projecting a beam of laser light upon the peripheral surface of the photosensitive drum 100; a developing apparatus 400 for developing an electrostatic latent image formed on the peripheral surface of the photosensitive drum 100, into a visible image, with the use of developer (toner); a transferring apparatus 500 for transferring the visible image (image formed of toner) onto a recording medium 900; a cleaning apparatus 600 for removing the toner remaining on the peripheral surface of the photosensitive drum 100 after the transfer, or the like residues; a fixing apparatus 800 for permanently fixing the visible image (image formed of toner) on the recording medium 900 to the recording medium 900; a cassette 700 for feeding the recording media 900 into the main assembly of the image forming apparatus; and a two-sided recording unit 1,000 which makes a recording medium 900 switch in direction to form an image on the reverse surface of the recording medium 900.

The photosensitive drum 100, charging apparatus 200, developing apparatus 400, transferring apparatus 500, fixing apparatus 800, cleaning apparatus 600, and cassette 700, of this image forming apparatus are the same in structure and function as those in the first embodiment, and therefore, their structures and their functions will be not be described. Incidentally, they are not shown in FIG. 3. Thus, this embodiment will be described starting from the transition from the image fixing step to the sequence carried out by the two-sided recording mode unit 1,000 to form an image on the reverse surface of the recording medium 900, after the recording medium 900 is conveyed through the fixing apparatus 800.

After being conveyed through the fixing apparatus 800, the recording medium 900 is made to switch in direction by a switchback roller 1001 disposed downstream of the fixing apparatus 800 in terms of the recording medium conveyance direction, in order to form an image on the reverse surface of the recording medium 900. As the recording medium 900 is made to switch in direction, it is conveyed behind the fixing apparatus 800 to the two-sided recording mode unit 1,000, through which it is conveyed by a pair of re-feeder rollers 703 to a pair of registration rollers 702 in synchronism with the progression of the formation of the image, on the peripheral surface of the photosensitive drum 100, to be transferred onto the reverse surface of the recording medium 900. Then, the recording medium 900 is conveyed by the registration rollers 702 to the transferring apparatus 500, so that its arrival at the transferring apparatus will synchronize with the arrival of the leading end of the image formed on the photosensitive drum, at the transferring apparatus. Then, the visible image on the photosensitive drum is transferred by the transferring apparatus 500 onto the recording medium 900.

In the case of the image forming apparatus in this embodiment, it is roughly four seconds from the completion of the formation of an image on the first surface of the recording medium 900 to the completion of the formation of an image on the second surface, that is, from the moment the trailing end of the recording medium 900, on the first surface of which an image has just been formed, comes out of the transfer nip, to the moment the recording medium 900 reaches the transfer nip so that an image can be formed on the second surface thereof. Therefore, the photosensitive drum 100 is rotated roughly four full turns during the above described period.

After the transfer of an image onto the second surface of the recording medium 900, the recording medium 900 is conveyed again to the fixing apparatus 800, in which the image on the second surface is fixed to the recording medium 900 with the application of heat and pressure. Then, the recording medium 900 is discharged from the main assembly of the image forming apparatus.

Meanwhile, the transfer residual toner, that is, the toner remaining on the area of the peripheral surface of the photosensitive drum 100, which has moved past the transferring apparatus, is removed from the photosensitive drum 100 by the cleaning apparatus 600 having a cleaning blade 601 formed of polyurethane rubber, and then, is stored in a waste toner container 602. Thereafter, the area of the peripheral surface of the photosensitive drum 100, which has just been cleared of the transfer residual toner, is charged again for the following image forming process, by the charging apparatus 200.

As described above, when recording on both surfaces of a recording medium 900, the interval in time between the process of forming an image forming on the first surface of the recording medium 900 and the process of forming an image on the second surface is roughly four seconds. In other words, it is greater than the interval in time between the operation carried out in the first embodiment, for forming an image on only one surface of a recording medium 900, and the operation carried out immediately thereafter to form an image on the surface of the following recording medium 900. When the interval in time between the formation of an image on the first surface of a recording medium 900 and the formation of an image on the second surface of the recording medium 900 is greater, as described above, than the length of time it takes for the photosensitive drum to be rotated by one full turn, the transferring apparatus must be kept activated at least for a length of time equivalent to the length of time by which the length of the interval between the formation of an image on the top surface (first surface) of the recording medium 900 and the formation of an image on the reverse surface of the recording medium 900 exceed the length of time (range designated by referential number 3) it takes for the photosensitive drum to be rotated one full turn, while charging the second area of the peripheral surface of the photosensitive drum, that is, the area corresponding to the image formation interval. Otherwise, the peripheral surface of the photosensitive drum is not reduced in potential level for the length of time equivalent to the difference between the length of the interval between the formation of an image on the top surface and the formation of an image on the reverse surface, and the length of time it takes for the photosensitive drum to rotate one full turn. Consequently, the peripheral surface of the photosensitive drum is charged again to a potential level equal to the potential level of the second area, while its potential level is remaining at the potential level of the second area. In other words, the contrast in potential level between the potential level of the peripheral surface of the photosensitive level prior to the charging thereof, and the potential level to which it is to be charge, is insufficient, causing the peripheral surface of the photosensitive drum to be nonuniformly charged. This nonuniformity in the potential level of the peripheral surface of a photosensitive drum affects the process of charging the first area, resulting in the formation of defective images.

Figure 4:
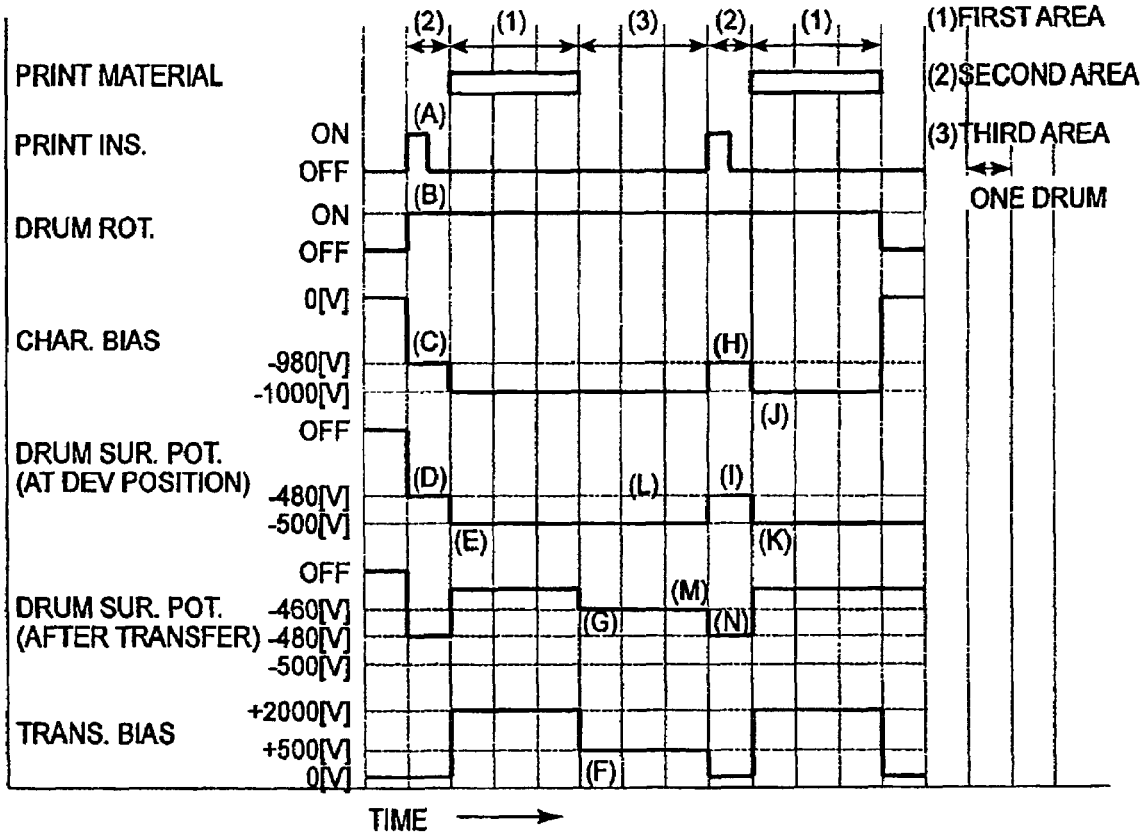
FIG. 4 is a timing chart of the image forming operation carried out by the image forming apparatus in the second embodiment.

In this embodiment, therefore, in order to prevent the peripheral surface of the photosensitive drum 100 from being nonuniformly charged, by realizing a sufficient amount of contrast in potential level when charging the second area, biases were controlled with the timing shown in FIG. 4, which is drawn to show the relationships among the charge bias, surface potential level (after being moved past charging apparatus), and transfer bias. In FIG. 4, a given point of the peripheral surface of the photosensitive drum is vertically aligned, and the length of the interval between adjacent two broken lines parallel to the vertical axis of the diagram is equivalent to the circumference of the photosensitive drum 100. The horizontal axis represents the length of the elapsed time. Further, the surface potential level of the photosensitive drum during the development process, and that after the transfer process, are individually presented. The surface potential level during the development process is equal to the surface potential level immediately after the charging of the photosensitive drum by the charging apparatus, and the surface potential after the transferring process is equal to the surface potential level immediately before the second area begins to be charged. Moreover, ordinarily, the first area of the peripheral surface of the photosensitive drum 100 is exposed according to the printing data and image data, which causes the potential level of each of the numerous exposed points of the first area to reduce to VL. However, for convenience, FIG. 4 shows only the potential level of the first area of the photosensitive drum 100 prior to the exposure.

In FIG. 4, the area of the peripheral surface of the photosensitive drum, which has just been charged by the charging apparatus, and across which a toner image is going to be formed, is called the first area. Further, the area of the peripheral surface of the photosensitive drum, which precedes the first area, by one full rotation of the photosensitive drum, in terms of the rotational direction of the photosensitive drum, and across which a toner image is not formed, is called the second area. Further, the area of the peripheral surface of the photosensitive drum, which precedes the second area by no less than one full turn of the photosensitive drum, and across which no image is formed, is called the third area.

As the main assembly of the image forming apparatus receives a print command from an external computer or the like (Step A), the rotation of the photosensitive drum 100 is started (Step B). Thereafter, in order to charge the second area, which precedes the first area across which an image is to be formed, −980 V of charge bias is applied to the charge roller 201 (Step C), charging the second area to 480 V, which is lower by 20 V in terms of absolute value than the potential level to which the first area is to be charged (Step D). Then, −1,000 V of charge bias is applied to the charge roller 201 to uniformly charge the first area to −500 V, which is the potential level (VD) to which the peripheral surface of the photosensitive drum is to be charged for image formation (Step E).

Thereafter, the same image forming sequence as that carried out by the image forming apparatus in the first embodiment is carried out by the exposing apparatus 300, developing apparatus 400, and transferring apparatus 500. Then, the recording medium 900 is conveyed to the fixing apparatus 800 in which the image on the recording medium 900 is fixed to the recording medium 900 by the application of heat and pressure.

Then, the recording medium 900 is made to switch in direction by a switchback roller 1,001, and is conveyed through the two-sided recording mode unit 1,000, by a pair of re-feeder rollers 703, to a pair of registration rollers 702, in synchronism with the progression of the process of forming the image, which is to be transferred onto the reverse surface of the recording medium 900. Then, the transferring process is carried out by the transferring member 500.

Next, the image forming sequence carried out by the image forming apparatus in this embodiment in order to form an image on the reverse surface of a recording medium 900 will be described. When forming an image on the reverse surface of the recording medium 900, −980 V of charge bias, which is lower in absolute value, as it was in the first embodiment, than the potential level of the charge bias applied to the first area, is applied to the second area of the peripheral surface of the photosensitive drum, that is, the area which corresponds to the interval between the image formation on the top surface (first surface) and the image formation on the bottom surface (second surface). The interval in time between the image formation on the top surface and the image formation on the reverse surface is roughly four seconds, which exceeds the length of time it takes for the photosensitive drum to rotate one full turn. Thus, immediately after the completion of the image formation on the top surface, −500 V of transfer bias is applied to the transfer roller 501 for three seconds, which is equivalent to three times the circumference of the photosensitive drum (third area) (Step F), removing thereby electrical charge from the peripheral surface of the photosensitive drum, reducing thereby the surface potential level of the photosensitive drum to −460 V to create the third area, which precedes the second area, and the potential level (−460 V) of which is lower than the potential level of the second area (Step M). Thereafter, no bias is applied to the transfer roller for one second (the very second immediately prior to starting of normal image forming operation), which is equal to the length of time it takes for the photosensitive drum to rotate one full turn, in order to prevent the hysteresis which the peripheral surface of the photosensitive drum suffers when the leading edge of a recording medium enters the transfer nip. Then, −980 V of charge bias is applied to the charge roller 201 (Step H), charging thereby the peripheral surface of the photosensitive drum to −480 V, which is lower by 20 V in terms of absolute value than the normal potential level for image formation (Step I), as in the first embodiment. While the transfer roller is in contact with the second area, no bias is applied to the transfer roller. Therefore, the potential level of the second area remains at −480 V (Step N).

Thereafter, when charging the first area, that is, the area of the peripheral surface of the photosensitive drum, across which an image is formed to be transferred onto the reverse surface of the recording medium, −1,000 V, or the potential level of the normal charge bias, is applied to the charge roller 201 (Step J), charging thereby the first area to −500 V, which is the normal potential level for image formation (Step K).

Therefore, a substantial amount of difference in potential level is created between the first and second areas, preventing thereby the peripheral surface of the photosensitive drum from being nonuniformly charged.

Incidentally, the size of the third area, in terms of the recording medium conveyance direction, is no less than twice the circumference of the photosensitive drum, as it is in this embodiment, the peripheral surface of the photosensitive drum is nonuniformly charged unless the amount of difference in potential level at the borderline between the aforementioned areas is no less than the predetermined value each time the borderline is moved past the charging member. In this embodiment, the third area is discharged by the transferring member to reduce the potential level of the third area to −460 V (Step G), and then, is charged by the charging apparatus to −500 V (Step L). In other words, there is a substantial amount of contrast in potential level. Therefore, it does not occur that the peripheral surface of the photosensitive drum is nonuniformly charged.

The following Table 2 shows the results of the tests carried out to examine the effectiveness of the above described sequence for preventing the peripheral surface of the photosensitive drum from being nonuniformly charged. In the tests, the difference in surface potential level between the second and third areas was widened by changing the transfer bias applied to create the third area, and the presence (absence) of the image defects attributable to nonuniformity in the charging of the peripheral surface of the photosensitive drum was checked. In Table 2, that the difference in potential level is 0 V means that the transfer bias was not applied to create the third area, in other words, the charge bias applied to the second area was continuously applied, without applying transfer bias.

TABLE 2

| Potential difference between 2nd area and 3rd area | Image defect |
|---|---|
| 0 V | Yes |
| 5 V | Almost Non |
| 10 V | Almost Non |
| 15 V | Almost Non |
| 20 V | Non |
| 25 V | Non |
| 30 V | Non |

As will be evident from the results shown in Table 2, when the different in potential level between the second and third areas was no less than 20 V in absolute value, no image suffering from the defects attributable to the nonuniform charging of the photosensitive drum was yielded; very satisfactory images were yielded.

In this embodiment, if the second area, which corresponds to the interval between the image formation on the top surface and the image formation on the reverse surface, is greater the circumference of the photosensitive drum, the third area, which is different in potential level by no less than 20 V in absolute value from the second area, is created as shown in FIG. 4 to realize a satisfactory amount of contrast in potential level between the area preceding the second area, in terms of the rotational direction of the photosensitive drum, and the second area. Therefore, the second area was uniformly charged. As a result, the process of charging the first area was not affected by the hysteresis, and therefore, was satisfactorily charged.

Further, regarding the third area, no less than 40 V of difference in potential level is provided between the potential level of the peripheral surface of the photosensitive drum immediately before the photosensitive drum is charged by the charge roller (surface potential level of photosensitive drum after image transfer in FIG. 4), and the potential level of the peripheral surface of the photosensitive drum, to which the peripheral surface of the photosensitive drum is to be charged (surface potential level of point of photosensitive drum in developing area in FIG. 4). Therefore, it also does not occur that the portion of the peripheral surface of the photosensitive drum, which corresponds to the third area, is unsatisfactorily charged. Therefore, it is possible to yield excellent images.

As described above, in this embodiment, when the image forming apparatus is in the two-sided recording mode, the third area, which precedes the second area and is lower in potential level than the second area, is created by applying −500 V to the transferring member. In other words, the third area, which precedes the second area, and is −460 V in potential level, is created. In the tests, in which 10,000 copies were continuously made with the image forming apparatus set as described above, excellent images, that is, images which did not suffer from the defects attributable to the nonuniform charging of the photosensitive drum resulting from the insufficient amount of contrast in potential level between the area of the peripheral surface of the photosensitive drum, which immediately preceded the area of the peripheral surface of the photosensitive drum, across which an image was to be formed, and the area across which an image was to be formed.

In this embodiment, the transferring member was used to create the third area with a predetermined potential level. However, the exposing apparatus may be utilized as an apparatus for changing the surface potential level of the photosensitive drum, in order to provide a sufficient amount of difference in potential level between the second and third areas. Further, instead of using the transfer roller or exposing means, the voltage applied to the charging apparatus may be switched with opportune timing so that a substantial amount of difference in potential level will be provided between the surface potential level of the photosensitive drum prior to the charging thereof for image formation, and the potential level to which the photosensitive drum is to be charged for image formation.

In essence, all that is necessary is to ensure that there will be a significant amount of difference between the potential level of the photosensitive drum before the photosensitive drum is charged by the charge roller for image formation, and the potential level to which the photosensitive drum is charged for image formation, by the charge roller. As for the means for providing this difference in potential level, any means, for example, the charge roller, transferring member, exposing apparatus, etc., is acceptable as long as it can change a photosensitive drum in surface potential level.

The difference in surface potential level between the second and third areas is desired to be set to an absolute value of no less than 20 V.

Although, in this embodiment, the second area was set lower in potential level, in terms of absolute value, than the first area, it may be set to be higher., instead, in potential level, in terms of absolute value, than the first area.

Further, in this embodiment, the present invention was applied to the image forming operation for automatically recording on both surfaces of a recording medium. However, the application of the present invention does not need to be limited to the above described image forming operation. That is, the present invention is also applicable to all of the following image forming operations: an image forming operation in which the size of the area (second area) of the peripheral surface of a photosensitive drum, which immediately precedes the area of the peripheral surface of the photosensitive drum, across which an image is formed, is rather long, in terms of the rotational direction of the photosensitive drum; an image forming operation in which the image formation intervals are rather long because of the variety in recording media; an image forming operation in which the second area of the peripheral surface of the photosensitive drum, that is, the area immediately preceding the first area of the peripheral surface of the photosensitive drum, that is, the area across which an image is formed, in terms of the rotational direction of the photosensitive drum, exceeds in length the circumference of the photosensitive drum; etc.

Further, the charge bias may be controlled as follows, as it is in the first embodiment. That is, the charge bias applied to the charge roller to charge the second area is changed to charge the second area to a potential level lower than the potential level to which the first area is charged. Further, the development bias to be applied while the second area is moved past the developing apparatus is changed by an amount equal to the difference in potential level between the first and second areas, so that a predetermined amount of difference is always maintained between the surface potential level and the development bias applied to the development roller. In essence, for the reduction of toner consumption and prevention of transfer roller contamination, it is desired that toner is prevented from adhering to the areas, other than the exposed points, of the peripheral surface of the photosensitive drum.

[Miscellanies]

Figure 5:
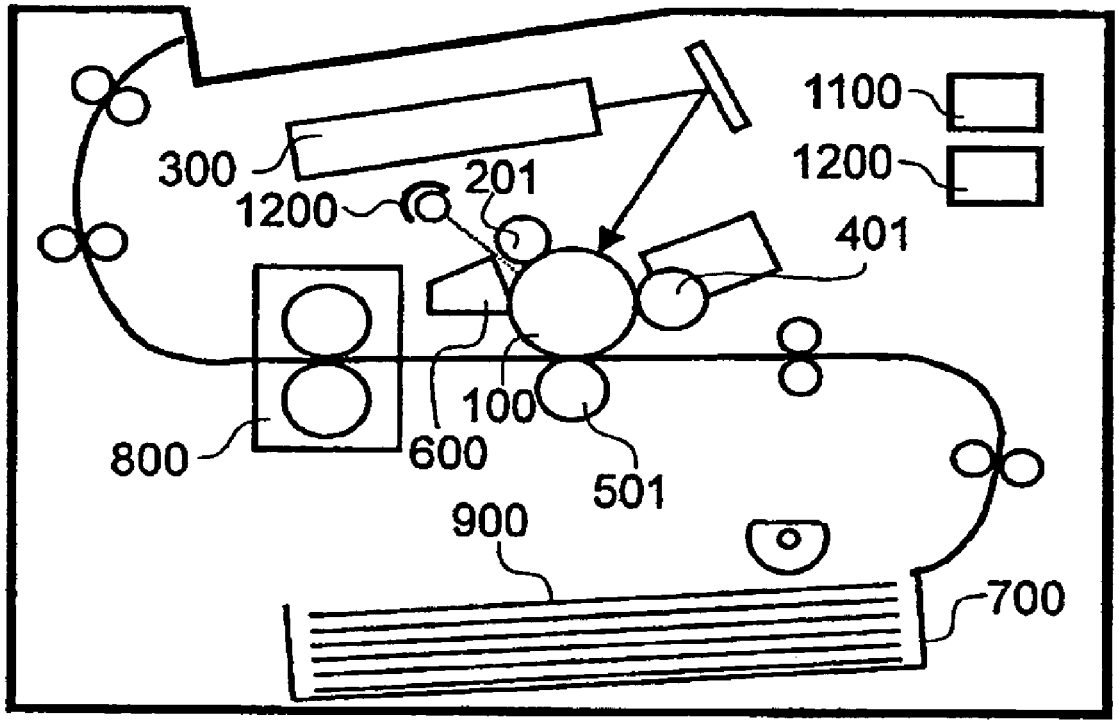
FIG. 5 is a schematic drawing of the image forming apparatus in another embodiment of the present invention.
Figure 6:
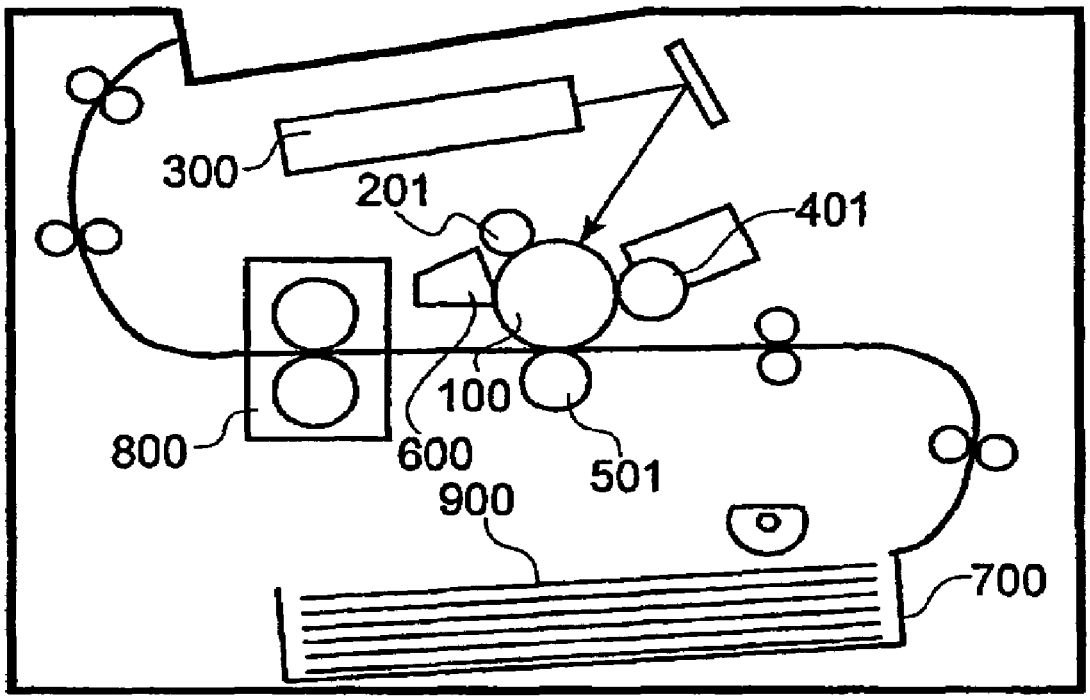
FIG. 6 is a schematic drawing of the image forming apparatus in accordance with the prior art, which employs one of the electrophotographic image forming methods.
Figure 7:
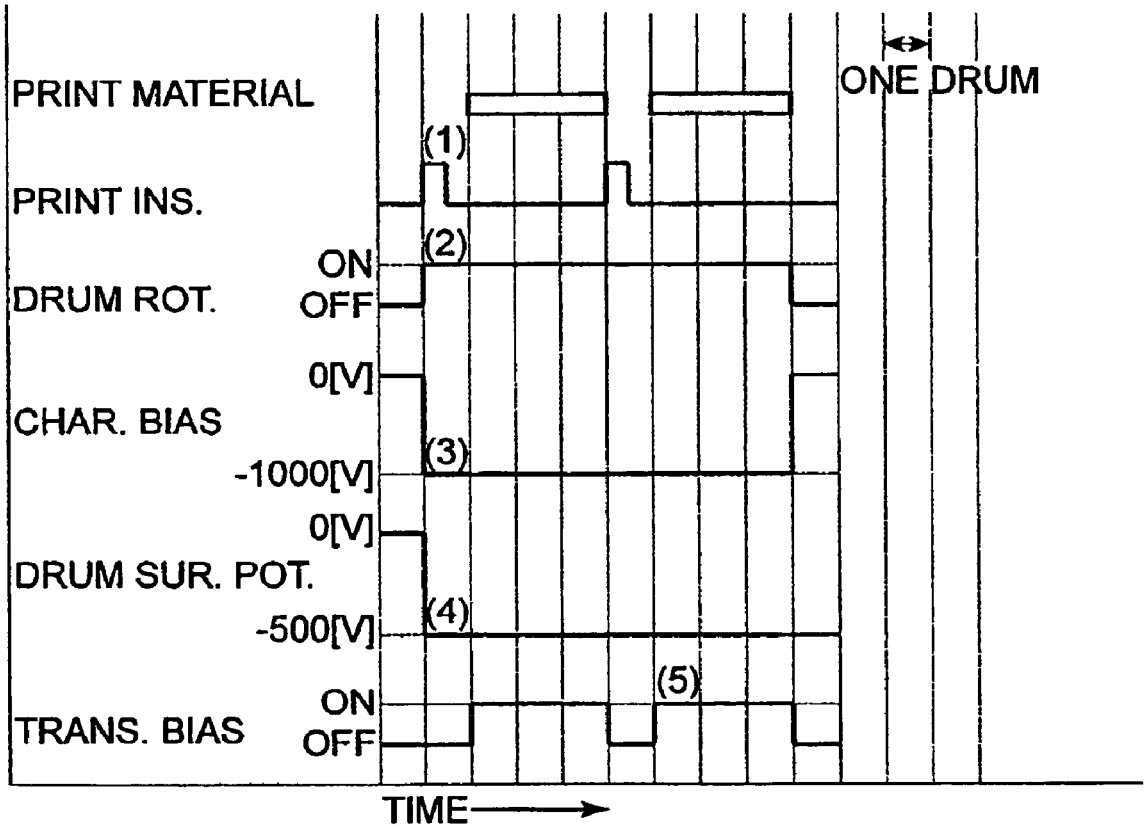
FIG. 7 is a timing chart of the image forming operation carried out by the image forming apparatus in accordance with the prior art, which employs one of the electrophotographic image forming methods.

In the first embodiment, the image forming apparatus was not provided with a pre-exposing apparatus, that is, an apparatus for pre-exposing a photosensitive drum in order to make the photosensitive drum uniform in the potential level of its peripheral surface before the photosensitive drum is charged by the charging apparatus. However, the present invention is also applicable to an image forming apparatus comprising a pre-exposing apparatus (FIG. 5). For example, the present invention is compatible with an image forming apparatus which has a pre-exposing apparatus and an ambience detecting means 1200, and determines, according to the ambient conditions, whether or not the photosensitive drum is to be pre-exposed. In the case of an image forming apparatus which does not pre-expose the photosensitive drum when the ambient temperature is low, a significant amount of contrast in potential level cannot be realized when the ambient temperature is low, as it was not by the image forming apparatus in the first embodiment. Therefore, the problem that the photosensitive drum is nonuniformly charged due to the insufficiency in the contrast in potential level occurs. In this case, the formation of defective images attributable to the nonuniform charging of the photosensitive drum can be prevented by setting the aforementioned biases so that a predetermined amount of difference in potential level is created between the first area, that is, the area across which an image is formed, and the second area which precedes the first area by a single full rotation of the photosensitive drum, when not pre-exposing the photosensitive drum. Incidentally, in the case of an image forming apparatus equipped with a pre-exposing apparatus, it is possible to utilize the pre-exposing apparatus as the apparatus for changing the photosensitive drum in potential level.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 150565/2004 and 145531/2005 filed May 20, 2004 and May 18, 2005, respectively, which are hereby incorporated by reference.

What is claimed is:

1. An image forming apparatus comprising:

a rotatable image bearing member on which an electrostatic latent image is formed;

a charging member for being supplied with a charging voltage which is a DC voltage not having an AC voltage component and for contacting said image bearing member to electrically charge a surface of said image bearing member using an electric discharge; and a transfer member for transferring onto a transfer material a toner image formed on the surface of said image bearing member by developing the electrostatic latent image, at a transfer position, wherein the charging potential of said charging member is different between, when said charging member provides a first region with a potential and when said charging member provides a second region with a potential, thus providing a predetermined potential difference between said first region and said second region, wherein said transfer member is not supplied with a voltage when said second region after being charged by said charging member is at the transfer position, wherein said first region is a region on said image bearing member which has been charged by said charging member and which is to be an image forming region, said second region is a region of said image bearing member which is a non-image-forming region in a rotation of said image bearing member immediately preceding said first region, and a third region proceeds said second region, wherein said charging member or said transfer member is supplied with the voltage to provide the predetermined potential difference between said second region and said third region, wherein said third region is a region of said image bearing member which is a non-image-forming region in a rotation of said image bearing member immediately previous to said second region and which corresponds to said second region on said image bearing member, and wherein when a length of said third region measured along a peripheral movement of the surface of said image bearing member is larger than one full-circumferential length of said image bearing member, said transfer member is supplied with the voltage to provide said predetermined potential difference between a potential of said third region before being charged by said charging member and a potential of said third region after being charged by said charging member.

2. An image forming apparatus comprising:

a rotatable image bearing member on which an electrostatic latent image is formed, a charging member for being supplied with a charging voltage which is a DC voltage not having an AC voltage component and for contacting said image bearing member to electrically charge a surface of said image bearing member using an electric discharge;

a transfer member for transferring onto a transfer material a toner image formed on the surface of said image bearing member by developing the electrostatic latent image, at a transfer position; and a potential changing device for changing a potential of said image bearing member, wherein the charging potential of said charging member is different between, when said charging member provides a first region with a potential and when said charging member provides a second region with a potential, thus providing a predetermined potential difference between said first region and said second region, wherein said transfer member is not supplied with a voltage when said second region after being charged by said charging member is at the transfer position, wherein said first region is a region on said image bearing member which has been charged by said charging member and which is to be an image forming region, said second region is a region of said image bearing member which is a non-image-forming region in a rotation of said image bearing member immediately preceding said first region, and a third region proceeds said second region, wherein said potential changing device is effective to provide said predetermined potential difference between said second region and said third region, wherein said third region is a region of said image bearing member which is a non-image-forming region in a rotation of said image bearing member immediately previous to said second region and which corresponds to said second region on said image bearing member, and wherein when a length of said third region measured along a peripheral movement of the surface of said image bearing member is larger than one full-circumferential length of said image bearing member, said potential changing device operates to provide said predetermined potential difference between a potential of said third region before being charged by said charging member and a potential of said third region after being charged by said charging member.

3. An apparatus according to claim 2, wherein said charging member is supplied with a constant voltage throughout said third region when said third region passes through said charging position.

4. An image forming apparatus comprising:

a rotatable image bearing member on which an electrostatic latent image is formed;

a charging member for being supplied with a charging voltage which is a DC voltage not having an AC voltage component and for contacting said image bearing member to electrically charge a surface of said image bearing member using an electric discharge; and a transfer member for transferring onto a transfer material a toner image formed on the surface of said image bearing member by developing the electrostatic latent image, at a transfer position, wherein the charging potential of said charging member is different between, when said charging member provides a first region with a potential and when said charging member provides a second region with a potential, thus providing a predetermined potential difference between said first region and said second region, wherein said transfer member is not supplied with a voltage when said second region after being charged by said charging member is at the transfer position, wherein said first region is a region on said image bearing member which has been charged by said charging member and which is to be an image forming region, said second region is a region of said image bearing member which is a non-image-forming region in a rotation of said image bearing member immediately preceding said first region, and a third region proceeds said second region, wherein said charging member or said transfer member is supplied with the voltage to provide the predetermined potential difference between said second region and said third region, wherein said third region is a region of said image bearing member which is a non-image-forming region in a rotation of said image bearing member immediately previous to said second region and which corresponds to said second region on said image bearing member, and wherein when a length of said third region measured along a peripheral movement of the surface of said image bearing member is larger than one full-circumferential length of said image bearing member, said charging member is supplied with the voltage to provide said predetermined potential difference between a potential of said third region before being charged by said charging member and a potential of said third region after being charged by said charging member.

5. An apparatus according to claim 4, wherein said transfer member is not supplied with a voltage for said third region.

6. An image forming apparatus comprising:

a rotatable image bearing member on which an electrostatic latent image is formed;

a charging member for being supplied with a charging voltage which is a DC voltage not having an AC voltage component and for contacting said image bearing member to electrically charge a surface of said image bearing member using an electric discharge;

a transfer member for transferring onto a transfer material a toner image formed on the surface of said image bearing member by developing the electrostatic latent image, at a transfer position; and a potential changing device for changing a potential of said image bearing member, wherein the charging potential of said charging member is different between, when said charging member provides a first region with a potential and when said charging member provides a second region with a potential, thus providing a predetermined potential difference between said first region and said second region, wherein said transfer member is not supplied with a voltage when said second region after being charged by said charging member is at the transfer position, wherein said first region is a region on said image bearing member which has been charged by said charging member and which is to be an image forming region, said second region is a region of said image bearing member which is a non-image-forming region in a rotation of said image bearing member immediately preceding said first region, and a third region proceeds said second region which is a non-image-forming region, wherein said potential changing device is effective to provide said predetermined potential difference between said second region and said third region, wherein said third region is a region of said image bearing member which is a non-image-forming region in a rotation of said image bearing member immediately previous to said second region and which corresponds to said second region, and wherein when a length of said third region measured along a peripheral movement of the surface of said image bearing member is larger than one full-circumferential length of said image bearing member, said charging member is supplied with the voltage to provide said predetermined potential difference between a potential of said third region before being charged by said charging member and a potential of said third region after being charged by said charging member.

7. An apparatus according to claim 6, wherein said potential changing device is not operated for said third region.

8. An image forming apparatus comprising:

a rotatable image bearing member on which an electrostatic latent image is formed;

a charging member for being supplied with a charging voltage which is a DC voltage not having an AC voltage component and for contacting said image bearing member to electrically charge a surface of said image bearing member using an electric discharge; and a transfer member for transferring onto a transfer material a toner image formed on the surface of said image bearing member by developing the electrostatic latent image, at a transfer position, wherein the charging potential of said charging member is different between, when said charging member provides a first region with a potential and when said charging member provides a second region with a potential, thus providing a predetermined potential difference between said first region and said second region, wherein said transfer member is not supplied with a voltage when said second region after being charged by said charging member is at the transfer position, wherein said first region is a region on said image bearing member which has been charged by said charging member and which is to be an image forming region, said second region is a region of said image bearing member which is a non-image-forming region in a rotation of said image bearing member immediately preceding said first region, and a third region proceeds said second region, and wherein the transfer bias supplied to said transfer member is controlled for a constant voltage when said transfer member is opposed to said image forming region.

9. An image forming apparatus comprising:

a rotatable image bearing member on which an electrostatic latent image is formed;

a charging member for being supplied with a charging voltage which is a DC voltage not having an AC voltage component and for contacting said image bearing member to electrically charge a surface of said image bearing member using an electric discharge; and a transfer member for transferring onto a transfer material a toner image formed on the surface of said image bearing member by developing the electrostatic latent image, at a transfer position, wherein the charging potential of said charging member is different between, when said charging member provides a first region with a potential and when said charging member provides a second region with a potential, thus providing a predetermined potential difference between said first region and said second region, wherein said transfer member is not supplied with a voltage when said second region after being charged by said charging member is at the transfer position, wherein said first region is a region on said image bearing member which has been charged by said charging member and which is to be an image forming region, said second region is a region of said image bearing member which is a non-image-forming region in a rotation of said image bearing member immediately preceding said first region, and a third region proceeds said second region, wherein said charging member or said transfer member is supplied with the voltage to provide the predetermined potential difference between said second region and said third region, wherein said third region is a region of said image bearing member which is a non-image-forming region in a rotation of said image bearing member immediately previous to said second region and which corresponds to said second region on said image bearing member, and wherein when the toner image is transferred onto only one side of the transfer material by said transfer member, said third region is not provided, and when the toner image is transferred onto each of sides of the transfer material, said third region is provided.

10. An image forming apparatus comprising:

a rotatable image bearing member on which an electrostatic latent image is formed;

a charging member for being supplied with a charging voltage which is a DC voltage not having an AC voltage component and for contacting said image bearing member to electrically charge a surface of said image bearing member using an electric discharge;

a transfer member for transferring onto a transfer material a toner image formed on the surface of said image bearing member by developing the electrostatic latent image, at a transfer position, and a pre-exposure device, disposed between said transfer member and said charging member with respect to a peripheral movement of the surface of said image bearing member, for exposing a surface of said image bearing member to light, wherein the charging potential of said charging member is different between, when said charging member provides a first region with a potential and when said charging member provides a second region with a potential, thus providing a predetermined potential difference between said first region and said second region, wherein said transfer member is not supplied with a voltage when said second region after being charged by said charging member is at the transfer position, wherein said first region is a region on said image bearing member which has been charged by said charging member and which is to be an image forming region, said second region is a region of said image bearing member which is a non-image-forming region in a rotation of said image bearing member immediately preceding said first region, and a third region proceeds said second region, wherein said charging member or said transfer member is supplied with the voltage to provide the predetermined potential difference between said second region and said third region, wherein said third region is a region of said image bearing member which is a non-image-forming region in a rotation of said image bearing member immediately previous to said second region and which corresponds to said second region on said image bearing member, and wherein said image forming apparatus is operable in an operation mode in which said pre-exposure device exposes a region of said image bearing member which is to be said first region.

11. An image forming apparatus comprising:

a rotatable image bearing member on which an electrostatic latent image is formed;

a charging member for being supplied with a charging voltage which is a DC voltage not having an AC voltage component and for contacting said image bearing member to electrically charge a surface of said image bearing member using an electric discharge;

a transfer member for transferring onto a transfer material a toner image formed on the surface of said image bearing member by developing the electrostatic latent image, at a transfer position, and a potential changing device for changing a potential of said image bearing member, wherein the charging potential of said charging member is different between, when said charging member provides a first region with a potential and when said charging member provides a second region with a potential, thus providing a predetermined potential difference between said first region and said second region, wherein said transfer member is not supplied with a voltage when said second region after being charged by said charging member is at the transfer position, wherein said first region is a region on said image bearing member which has been charged by said charging member and which is to be an image forming region, said second region is a region of said image bearing member which is a non-image-forming region in a rotation of said image bearing member immediately preceding said first region, and a third region proceeds said second region, wherein said potential changing device is effective to provide said predetermined potential difference between said second region and said third region, wherein said third region is a region of said image bearing member which is a non-image-forming region in a rotation of said image bearing member immediately previous to said second region and which corresponds to said second region on said image bearing member, and wherein when the toner image is transferred onto only one side of the transfer material by said transfer member, said third region is not provided, and when the toner image is transferred onto each of sides of the transfer material, said third region is provided.

12. An image forming apparatus comprising:

a rotatable image bearing member on which an electrostatic latent image is formed;

a charging member for being supplied with a charging voltage which is a DC voltage not having an AC voltage component and for contacting said image bearing member to electrically charge a surface of said image bearing member using an electric discharge;

a transfer member for transferring onto a transfer material a toner image formed on the surface of said image bearing member by developing the electrostatic latent image, at a transfer position;

a potential changing device for changing a potential of said image bearing member; and a pre-exposure device, disposed between said transfer member and said charging member with respect to a peripheral movement of the surface of said image bearing member, for exposing a surface of said image bearing member to light, wherein the charging potential of said charging member is different between, when said charging member provides a first region with a potential and when said charging member provides a second region with a potential, thus providing a predetermined potential difference between said first region and said second region, wherein said transfer member is not supplied with a voltage when said second region after being charged by said charging member is at the transfer position, wherein said first region is a region on said image bearing member which has been charged by said charging member and which is to be an image forming region, said second region is a region of said image bearing member which is a non-image-forming region in a rotation of said image bearing member immediately preceding said first region, and a third region proceeds said second region, wherein said potential changing device is effective to provide said predetermined potential difference between said second region and said third region, wherein said third region is a region of said image bearing member which is a non-image-forming region in a rotation of said image bearing member immediately previous to said second region and which corresponds to said second region on said image bearing member, and wherein said image forming apparatus is operable in an operation mode in which said pre-exposure device exposes a region of said image bearing member which is to be said first region.

* * * * *